US012553309B2

(12) United States Patent
Liang et al.

(10) Patent No.: US 12,553,309 B2
(45) Date of Patent: Feb. 17, 2026

(54) ADJUSTABLE WHIPSTOCK ISOLATION MECHANISM

(71) Applicant: Halliburton Energy Services, Inc., Houston, TX (US)

(72) Inventors: Aihua Liang, Carrollton, TX (US); Christian Alexander Ramirez, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/492,307

(22) Filed: Oct. 23, 2023

(65) Prior Publication Data

US 2024/0141745 A1 May 2, 2024

Related U.S. Application Data

(60) Provisional application No. 63/419,379, filed on Oct. 26, 2022.

(51) Int. Cl.
*E21B 33/129* (2006.01)
*E21B 41/00* (2006.01)

(52) U.S. Cl.
CPC ..... *E21B 33/1293* (2013.01); *E21B 41/0035* (2013.01)

(58) Field of Classification Search
CPC . E21B 33/1293; E21B 44/0035; E21B 33/129
See application file for complete search history.

(56) References Cited

U.S. PATENT DOCUMENTS 2,121,002 A * 6/1938 Baker ..... E21B 33/134 166/134
3,002,561 A * 10/1961 Baker ..... E21B 33/1295 166/123
3,036,636 A * 5/1962 Clark, Jr. ..... E21B 23/06 166/134

(Continued)

FOREIGN PATENT DOCUMENTS

CN 104863540 A * 8/2015
CN 111594093 A * 8/2020 ..... B23P 15/00
WO 2014123517 A1 8/2014

*Primary Examiner* — Jennifer H Gay
(74) *Attorney, Agent, or Firm* — Scott Richardson; Parker Justiss, P.C.

(57) ABSTRACT

Provided is an anchoring/sealing subassembly, a well system, and a method. The anchoring/sealing subassembly, in one aspect, includes an isolation element mandrel, and an isolation element positioned about the isolation element mandrel. The anchoring/sealing subassembly, in one aspect, further includes a shear mandrel coupled to the isolation element mandrel, and a ratch latch body coupled to the isolation element. The anchoring/sealing subassembly, in one aspect; additionally includes a row of radially spaced apart slip ring shear feature openings located in a slip ring, and a row of radially spaced apart shear mandrel shear feature openings located in an isolation element mandrel, the row of slip ring shear feature openings and the row of shear mandrel shear feature openings operable to receive ones of shear features to shearingly couple the slip ring and the isolation element mandrel together.

21 Claims, 19 Drawing Sheets

(56) References Cited

U.S. PATENT DOCUMENTS 3,054,450 A * 9/1962 Baker, Jr. ..... E21B 33/1295 166/120
3,311,171 A * 3/1967 Castro ..... E21B 33/129 166/182
3,603,388 A * 9/1971 Current ..... E21B 33/1294 166/131
4,044,826 A * 8/1977 Crowe ..... E21B 23/06 166/182
4,153,109 A * 5/1979 Szescila ..... E21B 7/061 166/123
4,176,715 A * 12/1979 Bigelow ..... E21B 23/06 166/138
4,263,968 A * 4/1981 Garner, Jr. ..... E21B 33/1295 166/212
4,359,090 A * 11/1982 Luke ..... E21B 33/1293 166/217
4,397,355 A * 8/1983 McLamore ..... E21B 7/061 166/117.6
4,531,581 A * 7/1985 Pringle ..... E21B 33/1295 166/120
4,565,247 A * 1/1986 Tapp ..... E21B 23/06 166/123
4,796,707 A * 1/1989 Halbardier ..... E21B 33/127 166/182
4,924,941 A * 5/1990 Farley ..... E21B 33/124 166/134
4,984,636 A * 1/1991 Bailey ..... E21B 23/06 166/182
5,193,620 A 3/1993 Braddick
5,335,737 A 8/1994 Baugh
5,398,754 A * 3/1995 Dinhoble ..... E21B 23/0411 175/81
5,425,419 A * 6/1995 Sieber ..... E21B 7/061 166/117.6
5,586,601 A * 12/1996 Pringle ..... E21B 33/1295 166/212
5,884,699 A * 3/1999 Mullen ..... E21B 33/1293 166/134
6,732,801 B2 * 5/2004 Ohmer ..... E21B 41/0035 166/117.6
8,590,608 B2 * 11/2013 Linn ..... E21B 23/12 166/381
10,590,732 B2 * 3/2020 Ingram ..... E21B 33/12
12,173,573 B2 * 12/2024 Liang ..... E21B 23/01
2002/0121375 A1 * 9/2002 Ohmer ..... E21B 23/12 166/117.6
2012/0261130 A1 * 10/2012 Linn ..... E21B 41/0035 166/50
2015/0345241 A1 12/2015 Glaser et al.
2019/0186232 A1 * 6/2019 Ingram ..... E21B 33/129
2021/0095542 A1 4/2021 Sherlin et al.
2023/0107931 A1 * 4/2023 Liang ..... E21B 7/061 166/382
2023/0110168 A1 4/2023 Vemuri et al.
2023/0113169 A1 * 4/2023 Vemuri ..... E21B 31/002 175/62
2024/0141741 A1 * 5/2024 Liang ..... E21B 7/061
2024/0141745 A1 * 5/2024 Liang ..... E21B 41/0035
2024/0183234 A1 * 6/2024 Gar ..... E21B 23/01

* cited by examiner

ADJUSTABLE WHIPSTOCK ISOLATION MECHANISM

CROSS-REFERENCE TO RELATED APPLICATION

This application claims the benefit of U.S. Provisional Application Ser. No. 63/419,379, filed on Oct. 26, 2022, entitled "ADJUSTABLE WHIPSTOCK ISOLATION MECHANISM," commonly assigned with this application and incorporated herein by reference in its entirety.

BACKGROUND

The unconventional market is extremely competitive. The market is trending towards longer horizontal wells to increase reservoir contact. Multilateral wells offer an alternative approach to maximize reservoir contact. Multilateral wells include one or more lateral wellbores extending from a main wellbore. A lateral wellbore is a wellbore that is diverted from the main wellbore or another lateral wellbore.

The lateral wellbores are typically formed by positioning one or more deflector assemblies at desired locations in the main wellbore (e.g., an open hole section or cased hole section) with a running tool. The deflector assemblies are often laterally and rotationally fixed within the main wellbore using a wellbore anchor, and then used to create an opening in the casing.

BRIEF DESCRIPTION

Reference is now made to the following descriptions taken in conjunction with the accompanying drawings, in which.

Figure 2A:
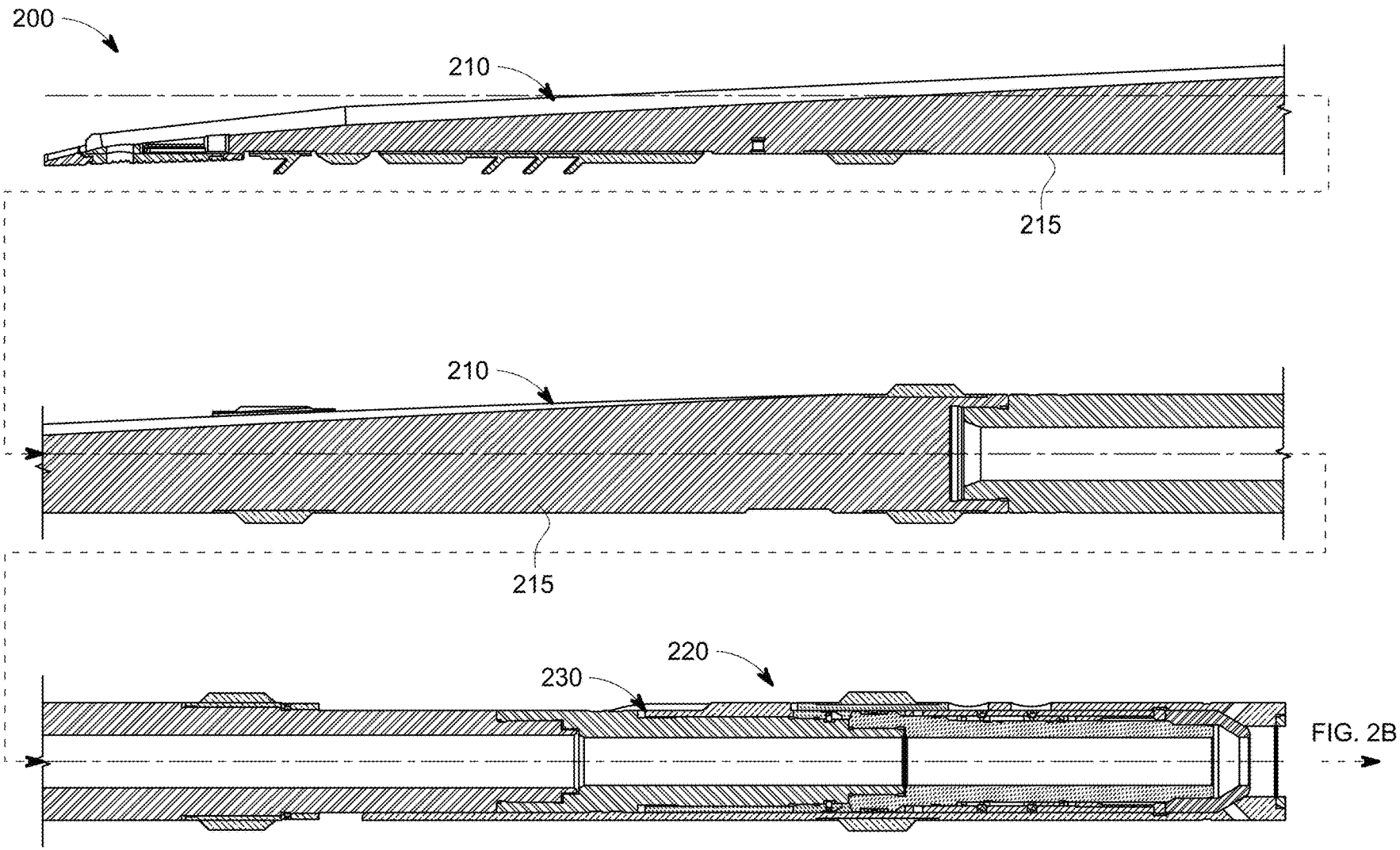
Figure 2B:
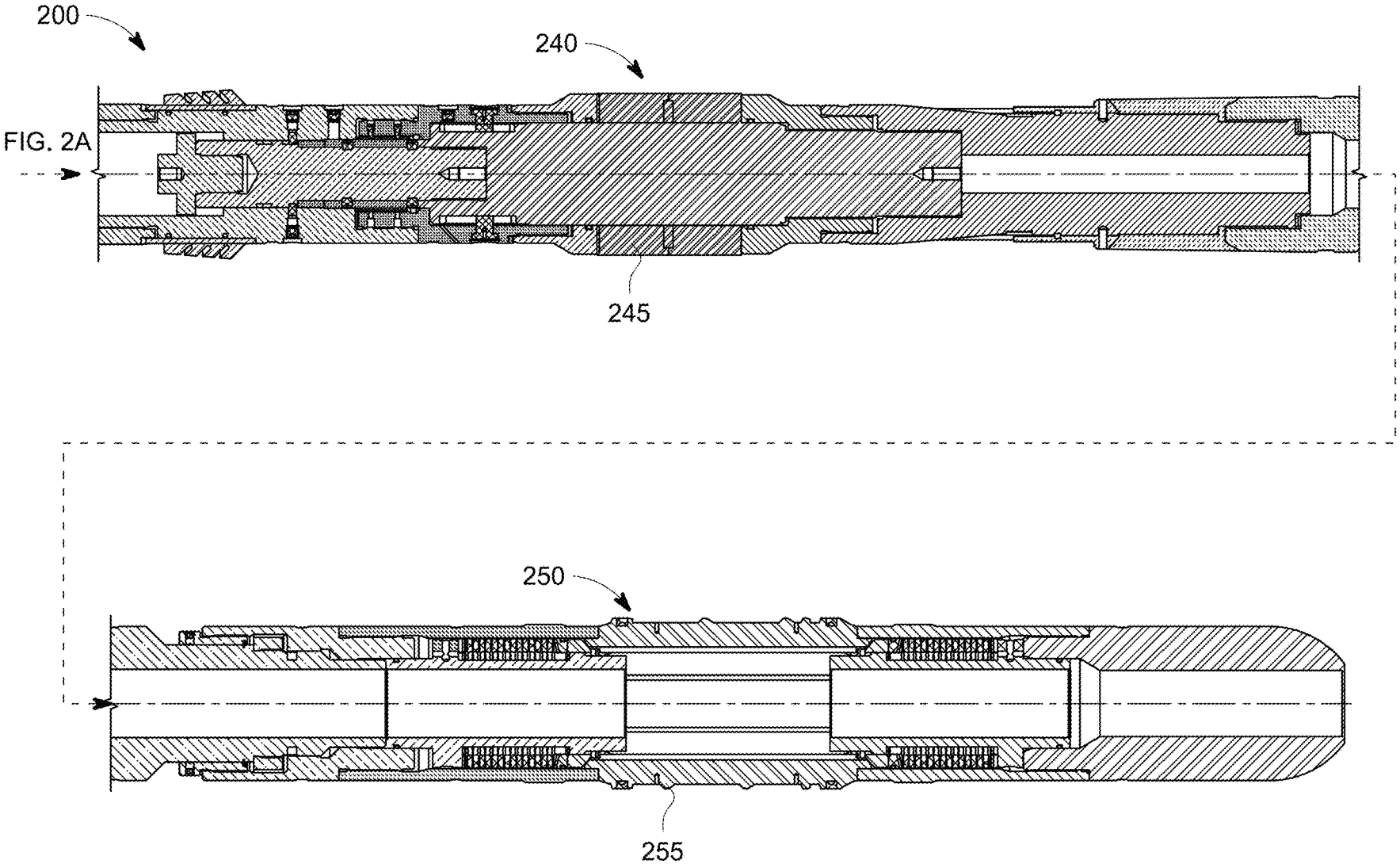
Figure 3:
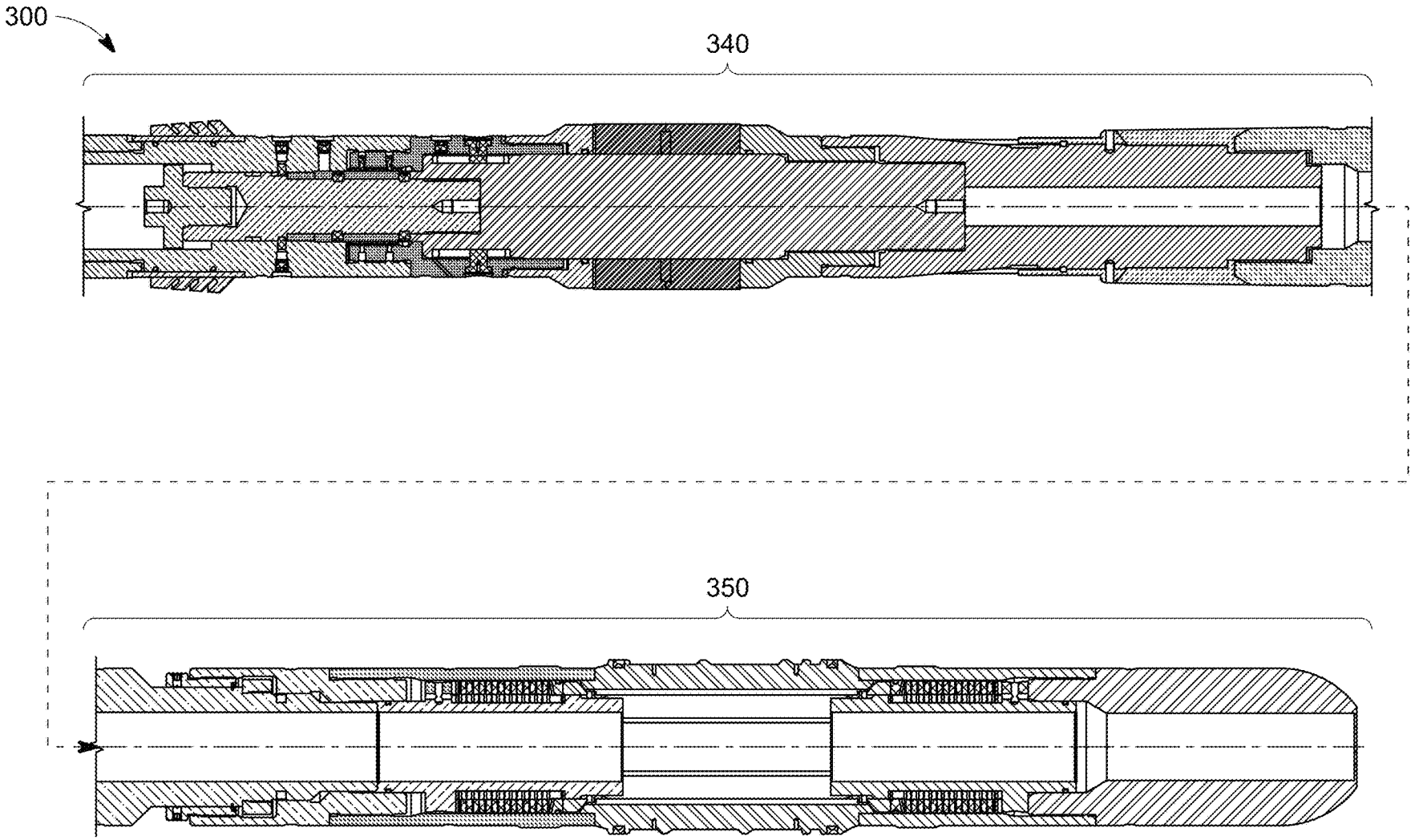
Figure 4A:
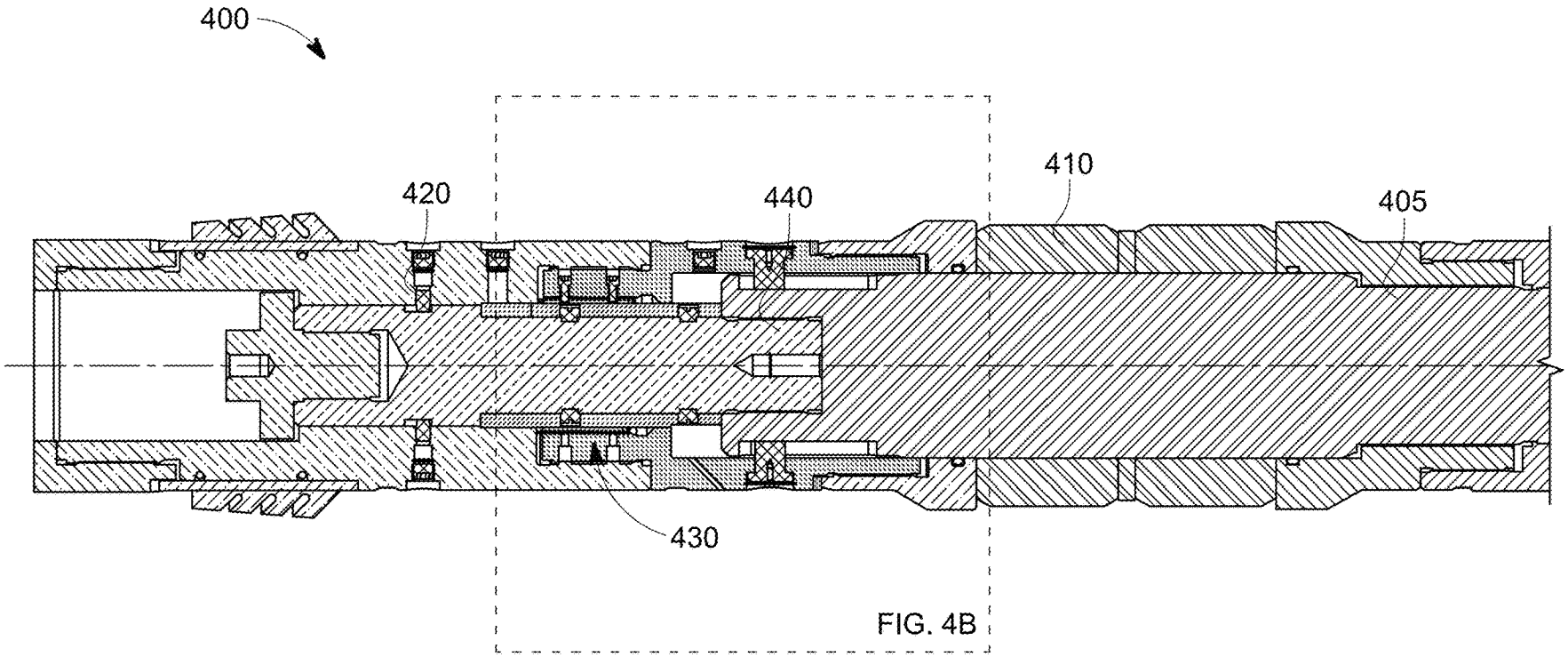
Figure 4B:
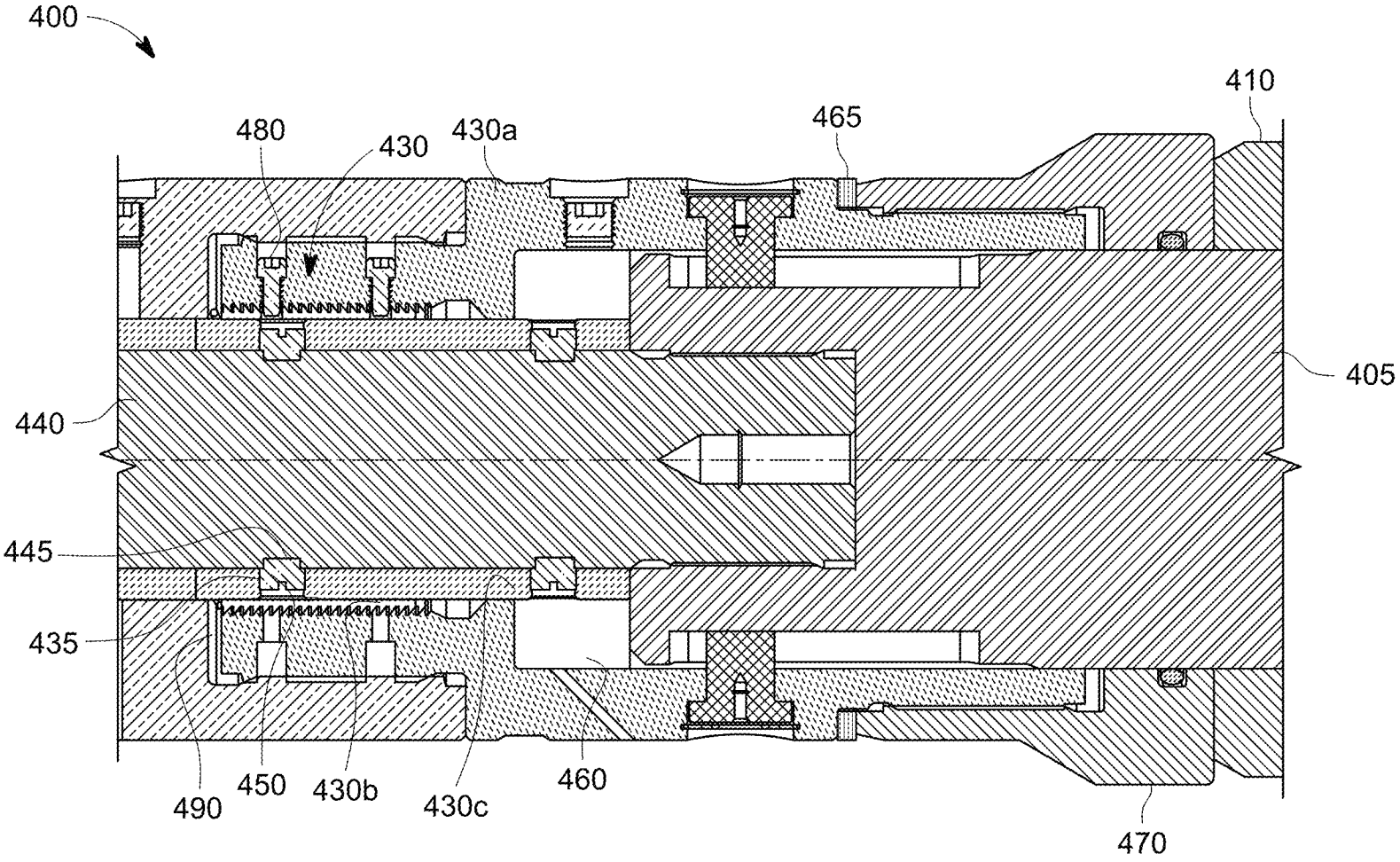

FIGS. 2A and 2B illustrated one embodiment of a whipstock assembly designed, manufactured and/or operated according to one or more embodiments of the disclosure;

FIG. 3 illustrates an alternative embodiment of an anchoring/sealing subassembly, the anchoring/sealing subassembly including a sealing section and a latching element section designed, manufactured and/or operated according to an alternative embodiment of the disclosure;

FIGS. 4A and 4B illustrate cross-sectional views of a portion of an anchoring/sealing subassembly designed, manufactured and/or operated according to one or more embodiments of the disclosure; and FIGS. 5A through 8B illustrate one embodiment for deploying, setting, relaxing (e.g., unsetting) and retrieving an anchoring/sealing subassembly designed, manufactured and/or operated according to one or more embodiments of the disclosure.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements, and may also include an indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water, such as ocean or fresh water.

The present disclosure is based, at least in part, on an isolation mechanism (e.g., whipstock isolation mechanism), for example used below the whipstock to block cement and debris while milling a window in the wellbore casing. The objectives of the isolation mechanism, among others, include: 1) the ability to hold pressure (e.g., provided by customer) after the isolation element is set; 2) the ability to remain set and hold pressure during the milling; 3) the ability to unset the isolation element when retrieving the isolation mechanism by pulling from above, for example to prevent swabbing that may result when pulling out of hole with an expanded isolation element; and 4) the ability for the isolation mechanism to be adjusted to easily handle different downhole conditions.

Figure 1A:
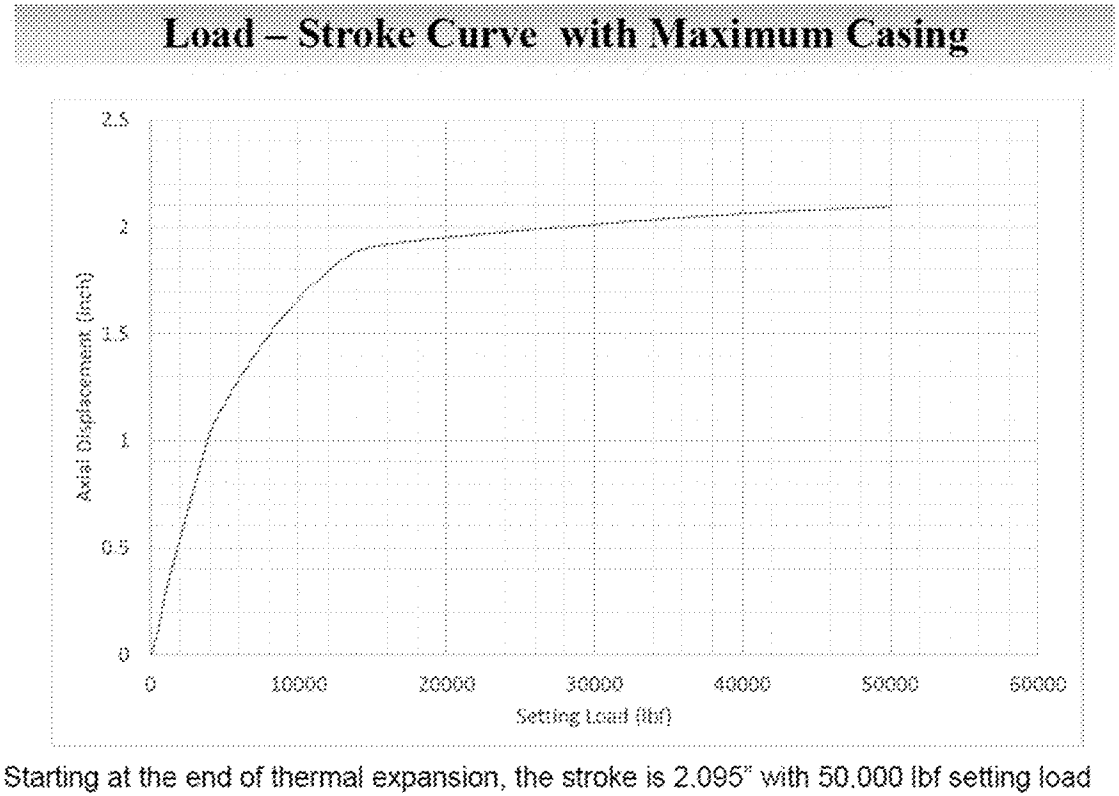
FIGS. 1A through 1E illustrate representative FEA simulations according to one or more embodiments of the disclosure.
Figure 1B:
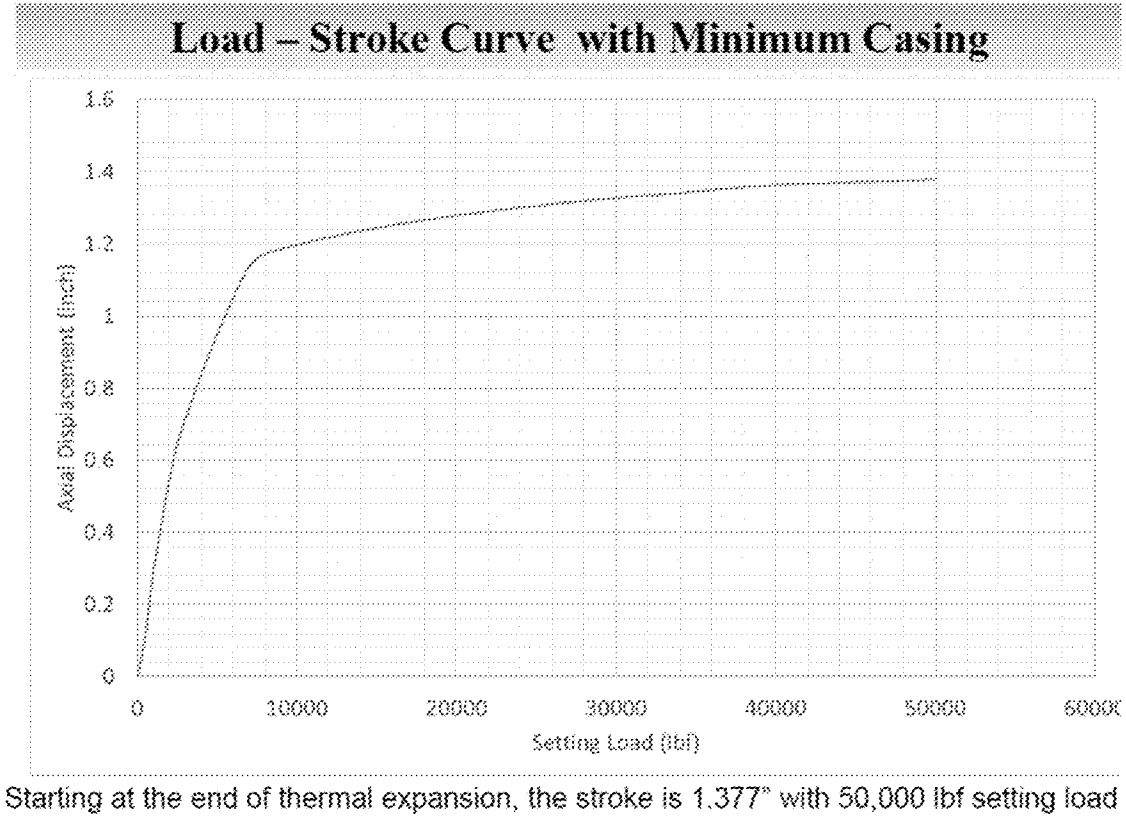

The present disclosure has recognized that the downhole wellbore casing inside diameter (ID) and downhole wellbore temperature greatly affect the ability of the isolation mechanism to be set, to provide the requisite amount of isolation when set, as well as to be unset when needed. Accordingly, the present disclosure provides an adjustable isolation mechanism, which can easily accommodate changes in the downhole wellbore casing ID and/or downhole wellbore temperatures. The adjustable isolation mechanism can be used for different downhole casing IDs. For example, the adjustable isolation mechanism can be adjusted to be easily set in minimum downhole casing IDs to maximum downhole casing IDs. Based on FEA results, for minimum downhole casing IDs, the setting force and stroke length are much smaller than those for maximum downhole casing IDs. The adjustable isolation mechanism gives the opportunity to control the proper setting force and stroke length for different downhole casing IDs and then hold for required pressure. See FIGS. 1A and 1B, which are FEA simulations of one example embodiment, wherein the stroke length at 50,000 lbs for a maximum downhole wellbore casing ID is >2.0 inches stroke, but for minimum downhole wellbore casing IDs, the stroke is much smaller (e.g., about 1.377 inches).

Figure 1C:
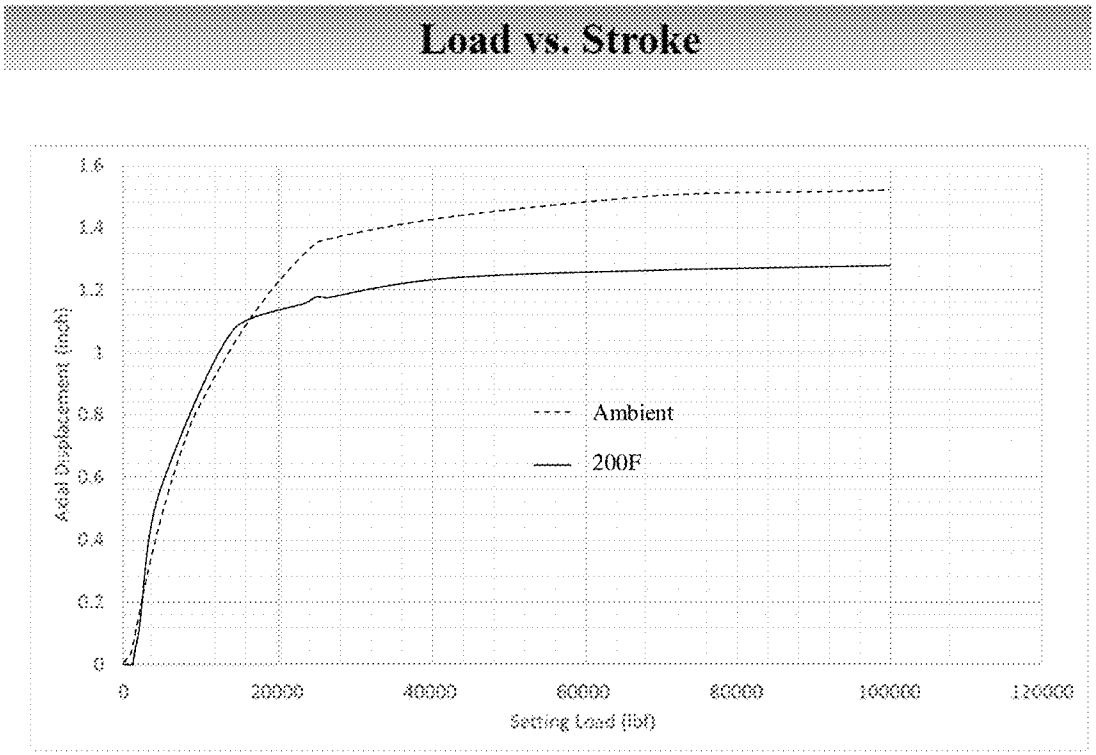

Similarly for different downhole casing IDs, the isolation elements perform differently with different temperatures. For example, contrary to conventional thinking, the present disclosure recognizes that the required stroke length to set the isolation elements at higher temperatures is smaller than the required stroke length to set the isolation elements at lower temperatures (e.g., based on FEA and test result within the same downhole wellbore casing ID). Accordingly, if the adjustable isolation mechanism will be run in the well at higher temperatures, lower setting load and stroke length are required for holding a required pressure, whereas if the adjustable isolation mechanism will be run in the wellbore at lower temperatures, higher setting load and stroke length will be required to hold the same required pressure. See FIG. 1C, which is a FEA simulation of Load vs. Stroke. The adjustable isolation mechanism according to the disclosure provides a mechanism for almost infinite adjustment to accommodate the different downhole wellbore temperatures.

Given the foregoing, the present disclosure has recognized that to make the adjustable isolation mechanism work properly, it may be helpful (e.g., if not imperative) to determine the downhole conditions, such as downhole wellbore casing ID, downhole wellbore temperature, and required holding pressure. With this information, some FEA simulations or tests may be conducted to get the proper stroke length and/or setting force for the determined downhole conditions. Accordingly, the adjustable isolation mechanism may be appropriately assembled with the proper stroke capacity and/or retaining shear mechanism to set the isolation elements, hold the isolation elements, and release the isolation elements, when needed.

Figure 1D:
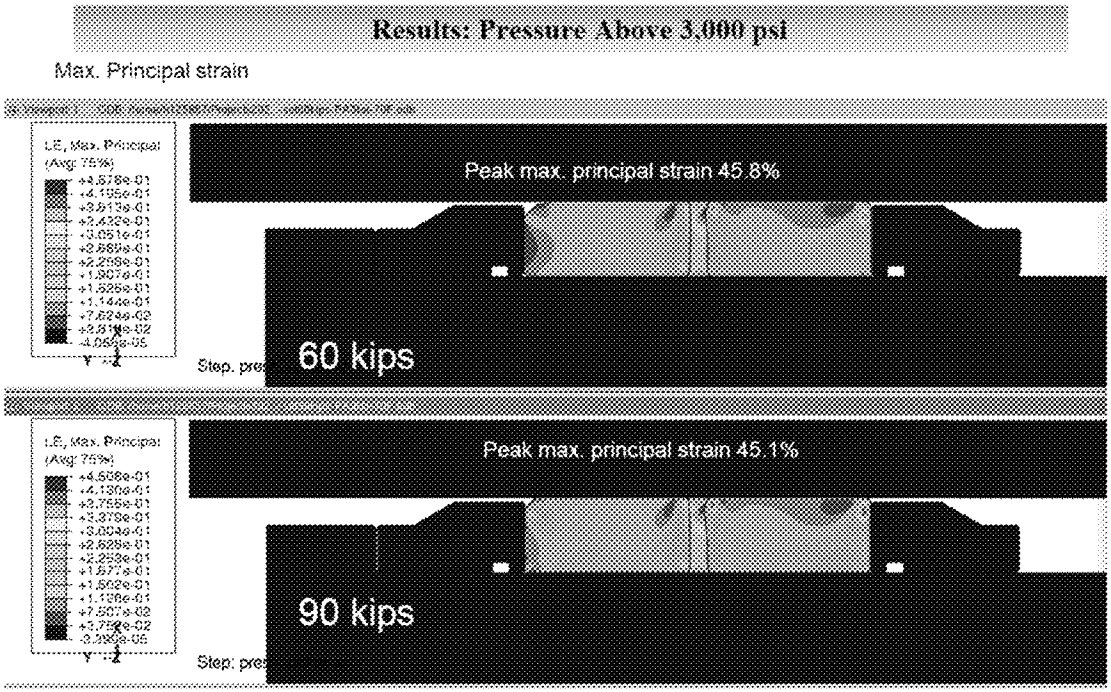
Figure 1E:
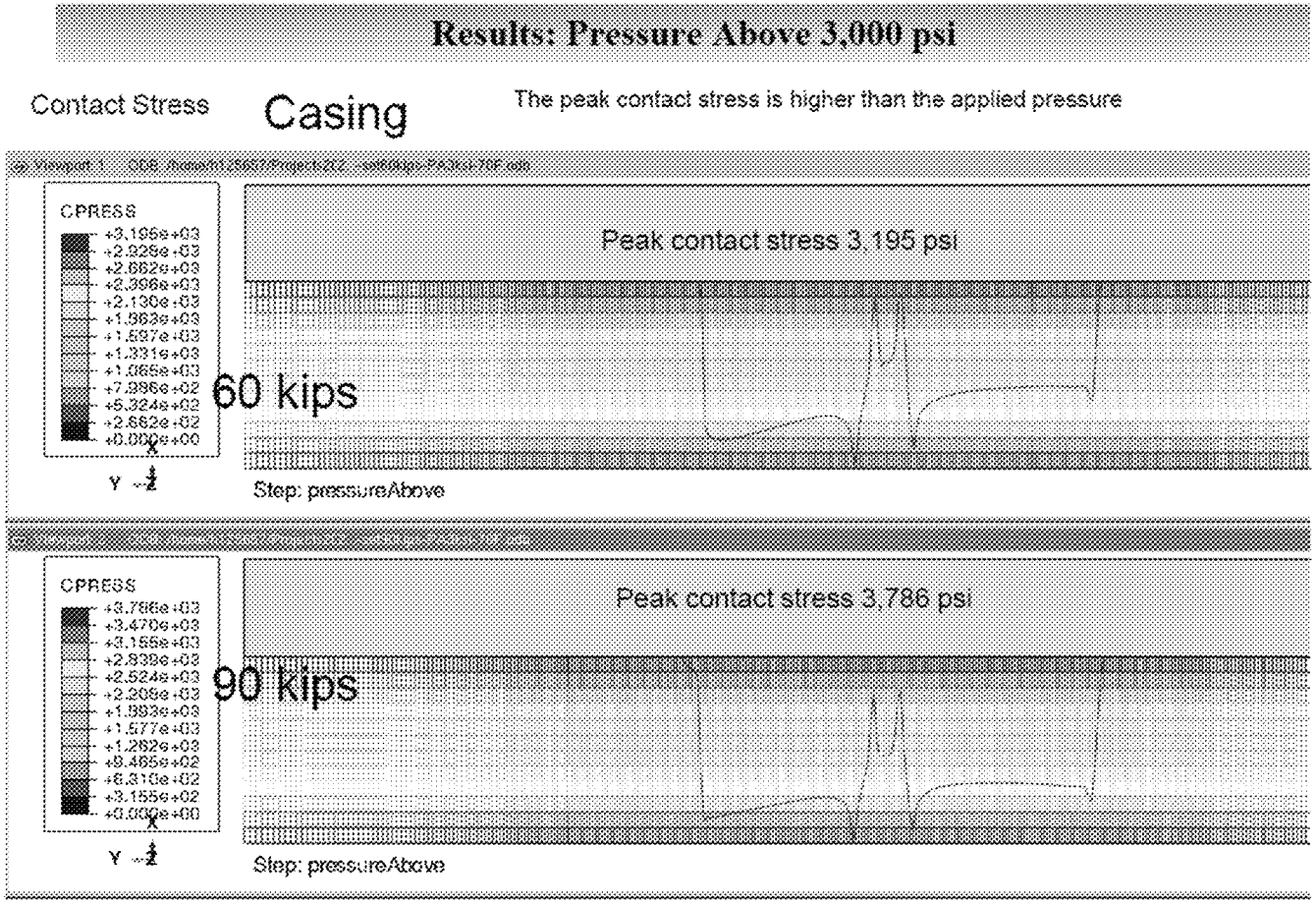

As one example, the FEA simulations shown in FIGS. 1D and 1E illustrate that in at least one embodiment for a specific downhole wellbore casing ID, and downhole wellbore temperature, when the setting load is at 60,000 lbs-90,000 lbs, the isolation elements hold pressure of 3,000 psi. These results provide the operator a choice of setting load ranges of 60,000 lbs to 90,000 lbs. The adjustable isolation mechanism, however, allows the user to pick the proper setting load for the isolation element, such that the system may operate properly.

In at least one embodiment, the present disclosure achieves the adjustability by including a row of slip ring shear feature openings (e.g., at least two rows of slip ring shear feature openings) in the slip ring of the adjustable isolation mechanism. Furthermore, the present disclosure achieves the adjustability by including a row of shear mandrel shear feature openings (e.g., at least two rows of shear mandrel shear feature openings) in the shear mandrel. For example, ones of shear features could be placed within one row of slip ring shear feature openings (e.g., first row of slip ring shear feature openings) and one row of shear mandrel shear feature openings (e.g., first row of shear mandrel shear feature openings), thereby shearingly coupling the slip ring to the shear mandrel. Alternatively, ones of shear features could be placed within ones of the second row of slip ring shear feature openings and second row of shear mandrel shear feature openings, thereby shearingly coupling the slip ring to the shear mandrel. In yet another embodiment, ones of shear features could be placed within ones of the first and second rows of slip ring shear feature openings and first and second rows of shear mandrel shear feature openings, thereby shearingly coupling the slip ring to the shear mandrel, for example to increase the shear force between the slip ring and shear mandrel. In yet other embodiments, three, four, five, or more rows of slip ring shear feature openings and shear mandrel shear feature openings exist, and different amounts of ones of shear features may be positioned in one or more of the rows to increase the shear force between the slip ring and the shear mandrel.

In at least one embodiment, the present disclosure also achieves the adjustability by increasing a stroke gap between the stroke sleeve and the isolation element mandrel to a value sufficient to accommodate most, if not any and all, downhole conditions (e.g., downhole casing ID, downhole wellbore temperature, hold pressure, etc.). With this increased stroke gap, a number of stroke adjustment spacers may be placed between the stroke sleeve and the downhole support shoe (e.g., upper support shoe in one embodiment) to adjust for the specific downhole conditions (e.g., the specific known downhole wellbore casing ID, downhole wellbore temperature, hold pressure, etc.).

In at least one embodiment, the process flow might go as follows: 1) before assembly, collect operational data for the wellbore, including downhole wellbore casing ID, downhole wellbore temperature, and downhole holding pressure; 2) perform FEA simulation for the isolation elements based upon the collected operational data, including simulating the proper setting force necessary to hold the required pressure, at a similar time, determining a stroke length at the setting load (e.g., or perform simplified setting and pressure test to get the data); 3) due to the large tolerance of the isolation elements, assemble the adjustable isolation mechanism with an appropriate number of stroke adjustment spacers (e.g., to adjust the stroke gap to be at the stroke as simulated or tested for the collected downhole wellbore casing ID and downhole wellbore temperature); and 4) install the proper number of shear features within the rows of shear feature openings in the slip ring and the shear mandrel (e.g., enough shear features to hold the setting load). It should be noted that too few shear features will not be strong enough to hold the energized isolation element, and to many shear features might have trouble when the system needs to shear to unset the isolation element to pull the adjustable isolation mechanism out. Thus, the ability to easily adjust the shear force (e.g., within the range discussed above) is an important part of the disclosure.

The adjustable isolation mechanism may include other important features while remaining within the scope of the disclosure. In at least one embodiment, the adjustable isolation mechanism includes a set of head screws aligned in a groove of the body lock ring to prevent the body lock ring from rotating (e.g., preventing it from un-threading from the stroke sleeve). In at least one other embodiment, a spring may be added in a gap between body lock ring and upper shoulder in the compressed position (e.g., to prevent or reduce the back lash from the body lock ring when it engages). In even yet another embodiment, grease or rubber material can be applied into the increased stroke gap and unset gap (e.g., to reduce impact load when set on the isolation element, and reduce debris from getting into critical areas of the device).

Figure 1F:
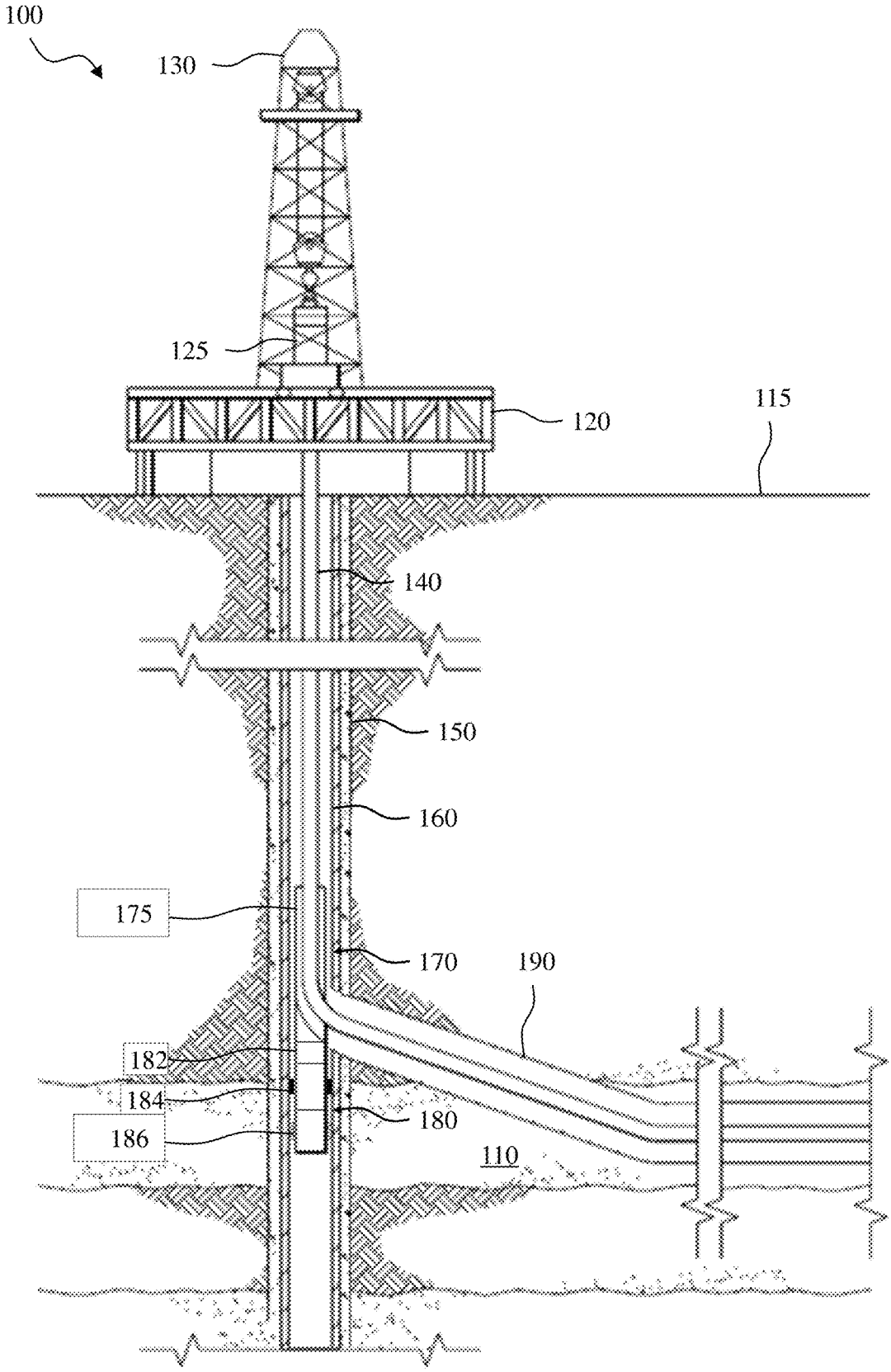
FIG. 1F illustrates a schematic view of a well system designed, manufactured and operated according to one or more embodiments disclosed herein.

FIG. 1F is a schematic view of a well system 100 designed, manufactured and/or operated according to one or more embodiments disclosed herein. The well system 100 includes a platform 120 positioned over a subterranean formation 110 located below the earth's surface 115. The platform 120, in at least one embodiment, has a hoisting apparatus 125 and a derrick 130 for raising and lowering one or more downhole tools including pipe strings, such as a drill string 140. Although a land-based oil and gas platform 120 is illustrated in FIG. 1F, the scope of this disclosure is not thereby limited, and thus could potentially apply to offshore applications. The teachings of this disclosure may also be applied to other land-based or offshore-based well systems different from that illustrated.

As shown, a main wellbore 150 has been drilled through the various earth strata, including the subterranean formation 110. The term "main" wellbore is used herein to designate a wellbore from which another wellbore is drilled. It is to be noted, however, that a main wellbore 150 does not necessarily extend directly to the earth's surface, but could instead be a branch of yet another wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

In the embodiment of FIG. 1F, a whipstock assembly 170 according to one or more embodiments of the present disclosure is positioned at a location in the main wellbore 150. Specifically, the whipstock assembly 170 could be placed at a location in the main wellbore 150 where it is desirable for a lateral wellbore 190 to exit. Accordingly, the whipstock assembly 170 may be used to support a milling tool used to penetrate a window in the main wellbore 150, and once the window has been milled and a lateral wellbore 190 formed, in some embodiments, the whipstock assembly 170 may be retrieved and returned uphole by a retrieval tool.

The whipstock assembly 170, in at least one embodiment, includes a whipstock element section 175, as well as an anchoring/sealing subassembly 180 coupled to a downhole end thereof. The anchoring/sealing subassembly 180, in one or more embodiments, includes an orienting receptacle section 182, a sealing section 184, and a latching element section 186. In at least one embodiment, the latching element section 186 axially, and optionally rotationally, fixes the whipstock assembly 170 within the casing string 160. The sealing section 184, in at least one embodiment, seals (e.g., provides a pressure tight seal to) an annulus between the whipstock assembly 170 and the casing string 160. In at least one embodiment, the sealing section 184 includes an adjustable isolation mechanism, as discussed above. The orienting receptacle section 182, in one or more embodiments, along with a collet and one or more orienting keys, may be used to land and positioned a guided milling assembly and/or the whipstock element section 175 within the casing string 160.

The elements of the whipstock assembly 170 may be positioned within the main wellbore 150 in one or more separate steps. For example, in at least one embodiment, the anchoring sub assembly 180, including the orienting receptacle section 182, sealing section 184 and the latching element section 186 are run in hole first, and then set within the casing string 160. Thereafter, the sealing section 184 may be pressure tested. Thereafter, the whipstock element section 175 may be run in hole and coupled to the anchoring/sealing subassembly 180, for example using the orienting receptacle section 182. What may result is the whipstock assembly 170 illustrated in FIG. 1F.

Turning now to FIGS. 2A and 2B, illustrated is one embodiment of a whipstock assembly 200 designed and manufactured according to one or more embodiments of the disclosure. The whipstock assembly 200, in the illustrated embodiment of FIGS. 2A and 2B, includes a whipstock element section 210, and an anchoring/sealing subassembly 220. The whipstock element section 210, in the illustrated embodiment, includes a whipstock element 215 (e.g., ramp element). The anchoring/sealing subassembly 220, in one or more embodiments, includes an orienting receptacle section 230 (e.g., including a muleshoe), a sealing section 240, and a latching element section 250. The sealing section 240, in the illustrated embodiment, includes an adjustable isolation mechanism, as discussed above. The sealing section 240, in the illustrated embodiment, among other features disclosed below, includes an isolation element 245, the isolation element 245 configured to move between a radially retracted state and a radially expanded state. The latching element section 250, in the illustrated embodiment, includes one or more latching features 255 (e.g., latch segments), the one or more latching features 255 configured to engage with a profile (e.g., latch coupling) in a casing string.

Turning to FIG. 3, illustrated is an alternative embodiment of an anchoring/sealing subassembly 300, the anchoring/sealing subassembly including a sealing section 340 and a latching element section 350 designed, manufactured and/or operated according to an alternative embodiment of the disclosure. The sealing section 340, latching element section 350 and an orienting element section (not shown in FIG. 3) may be run in hole within a main wellbore, set, and then pressure tested, prior to a whipstock element section (not shown in FIG. 3) of the whipstock assembly being run in hole and attached with the sealing section 340 (e.g., engaged with the orienting element section attached to the sealing section 340). Notwithstanding, FIG. 3 illustrates the latching element section 350 in the engaged state, as well as the sealing section 340 in the radially expanded state.

Turning to FIGS. 4A and 4B, illustrated are cross-sectional views of a portion of an anchoring/sealing subassembly 400 designed, manufactured and/or operated according to one or more embodiments of the disclosure. As is illustrated, in one or more embodiments, the anchoring/sealing subassembly 400 includes an isolation element mandrel 405 having one or more isolation elements 410 positioned thereabout. In at least one embodiment, the isolation element 410 is configured to move between a radially retracted state and a radially expanded state. In the embodiment of FIGS. 4A and 4B, the isolation element 410 is in its run-in-hole state, and thus is in its radially retracted state.

The anchoring/sealing subassembly 400, in the illustrated embodiment, additionally includes one or more setting shear features 420. In one or more embodiments, the one or more setting shear features 420 are used hold the isolation element 410 in its radially retracted state while running in hole, and thus allowing a flow path for cleaning the wellbore. The anchoring/sealing subassembly 400, in one or more embodiments, additionally includes a ratch latch body 430 (e.g., including a stroke sleeve 430*a*, body lock ring 430*b*, and slip ring 430*c* in one or more embodiments) for locking the isolation element 410 at a position while setting. The anchoring/sealing subassembly 400, in accordance with one embodiment of the disclosure, additionally includes a shear mandrel 440 (e.g., rigidly coupled to the isolation element mandrel 405).

In accordance with one embodiment of the disclosure, the slip ring 430*c* includes at least one row (e.g., at least two axially offset rows) of slip ring shear feature openings 435 and the shear mandrel 440 includes at least one row (e.g., at least two axially offset rows) of shear mandrel shear feature openings 445. In at least one embodiment, the anchoring/ sealing subassembly 400 may include at least 3, at least 4, at least 5, at least 6, etc. of rows of slip ring shear feature openings 435 and shear mandrel shear features openings 445 (e.g., each row including 2, 4, 8, 12, 16, 20, etc. radially spaced individual shear openings). Depending on the design of the device, ones of shear features 450 may be located in one or more of the rows of slip ring shear feature openings 435 and shear mandrel shear feature openings 445 to shearingly couple the sling ring 430*c* to the shear mandrel 440. For example, as discussed above, the downhole wellbore casing ID, downhole wellbore temperature, and/or setting pressure may be determined and used to decide how many shear features 450 are located in the ones of the rows of slip ring shear feature openings 435 and shear mandrel shear feature openings 445, thus setting up the adjustable isolation mechanism.

The anchoring/sealing subassembly 400, in at least one embodiment, may further include an increased stroke gap 460, as discussed above. The increased stroke gap 460, in this embodiment, sets the stroke length between the stroke sleeve 430*a* and the isolation element mandrel 405, which in turn sets the stroke length of the upper support shoe 470 on the isolation element 410. The anchoring/sealing subassembly 400, in at least one embodiment, may further include (e.g., may add or remove) one or more stroke adjustment spacers 465 between the stroke sleeve 430*a* and the upper support shoe 470. As discussed above, the inclusion of the increased stroke gap 460 and/or one or more stroke adjustment spacers 465 allows for the setting force to be tailored (e.g., infinitely tailored). The one or more stroke adjustment spacers 465 may be one or more similarly sized stroke adjustment spacers, or alternatively may be one or more different sized stroke adjustment spacers.

To properly design the increased stroke gap 460 and/or the number and size of the one or more stroke adjustment spacers 465, FEA simulations of the isolation element 410 positioned at conditions similar to the downhole conditions that the isolation element will ultimately be located is helpful, if not necessary. Again, FIGS. 1A through 1F illustrate one such set of FEA simulations.

Returning to FIGS. 4A and 4B, the anchoring/sealing subassembly 400 may additionally include one or more head screws 480 in a groove of the body lock ring 430*b*. Accordingly, the one or more head screws 480 may prevent the body lock ring 430*b* from rotating, thereby preventing it from un-threading. The anchoring/sealing subassembly 400 may additionally include one or more springs 490 (e.g., wavo springs) added in a gap between the body lock ring 430 and an upper shoulder in the compressed position. The one or more springs 490 may reduce or prevent any backlash from the body lock ring 430 when it engages.

Turning to FIGS. 5A through 8B, illustrated is one embodiment for deploying, setting, relaxing (e.g., unsetting) and retrieving an anchoring/sealing subassembly 500 designed, manufactured and/or operated according to one or more embodiments of the disclosure. The anchoring/sealing subassembly 500 is similar in many respects to the anchoring/sealing subassembly 400 described and illustrated with respect to FIGS. 4A and 4B. Accordingly, like reference numbers have been used to illustrate similar features. The anchoring/sealing subassembly 500 includes an isolation element 410, one or more setting shear features 420, a ratch latch body 430 (e.g., including shear sub 430*a*, body lock ring 430*b*, and slip ring 430*c*), at least one row (e.g., two or more laterally offset rows) of slip ring shear feature openings 435, a shear mandrel 440, at least one row (e.g., two or more laterally offset rows) of shear mandrel shear feature openings 445, ones of shear features 450, an increased stroke gap 460, and potentially one or more stroke adjustment spacers 465.

Figure 5A:
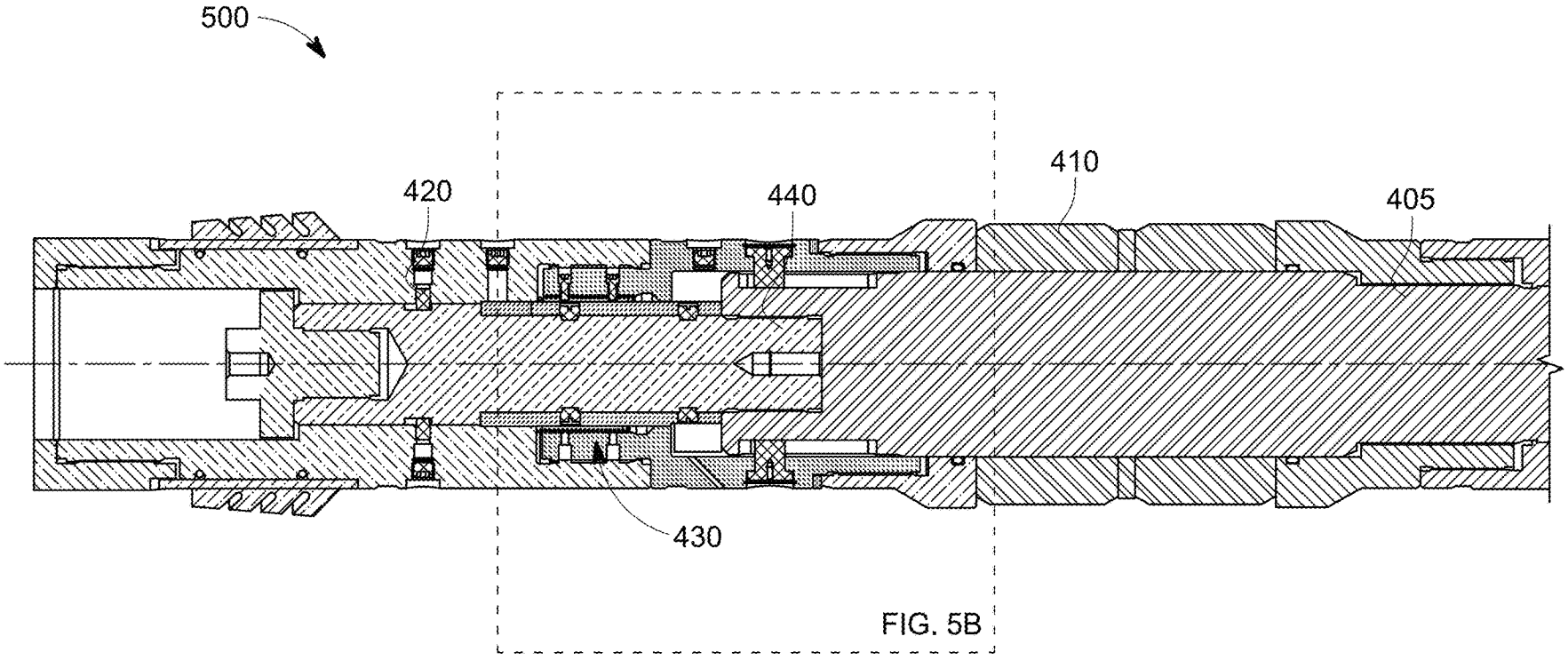
Figure 5B:
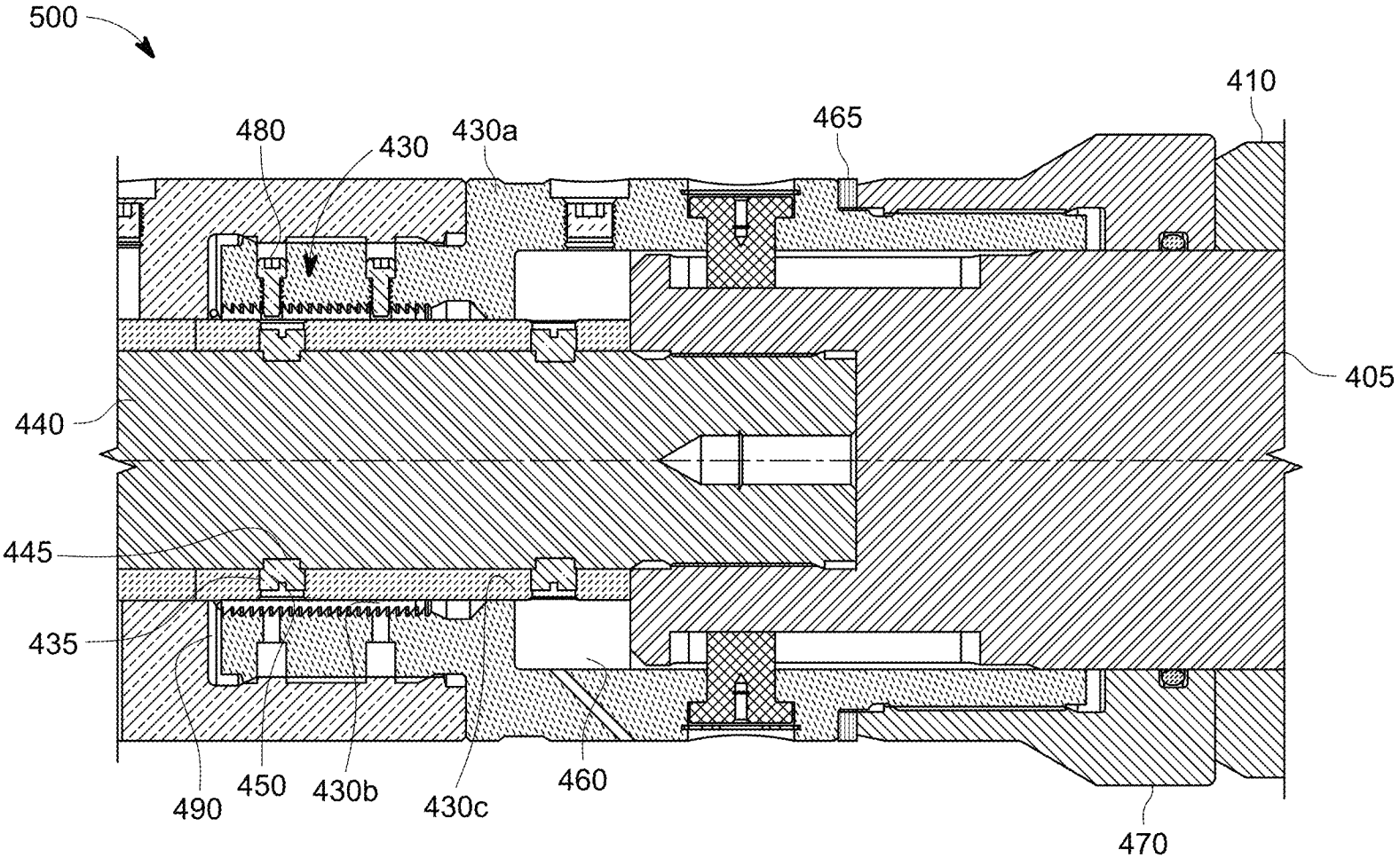
Figure 6A:
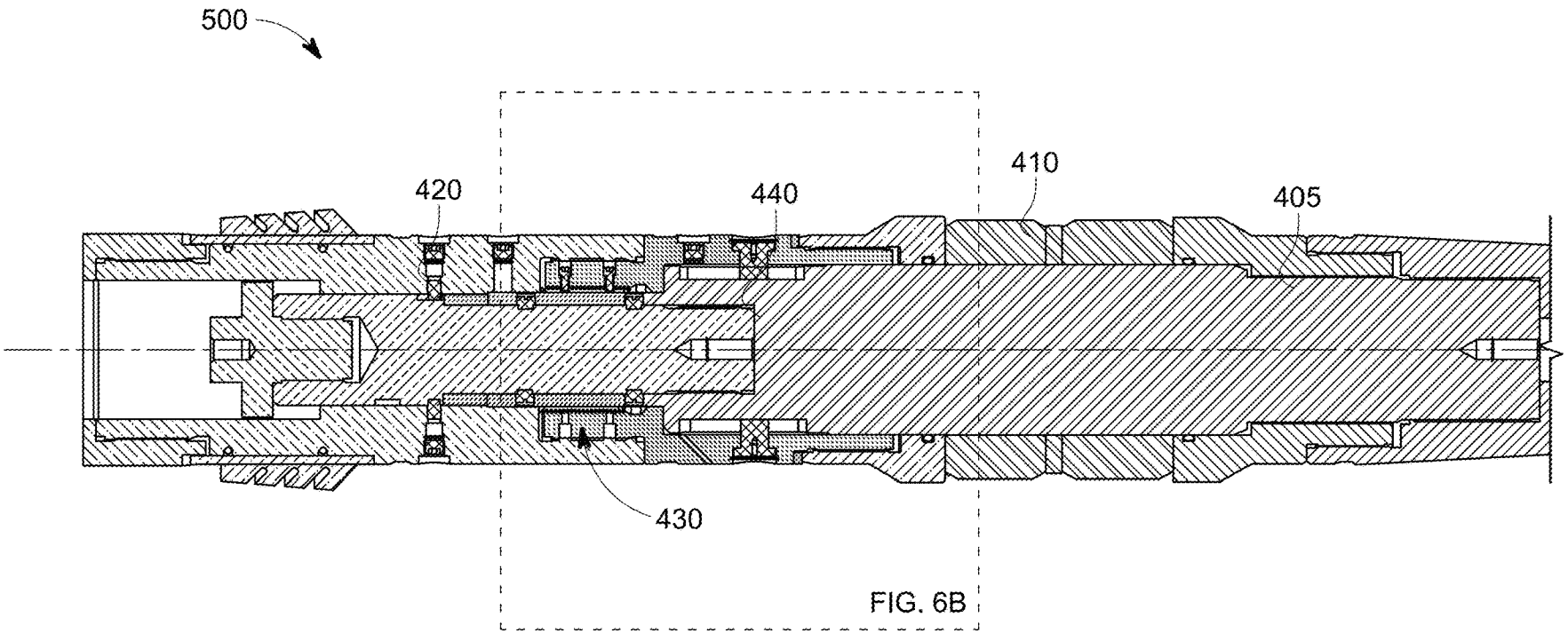
Figure 6B:
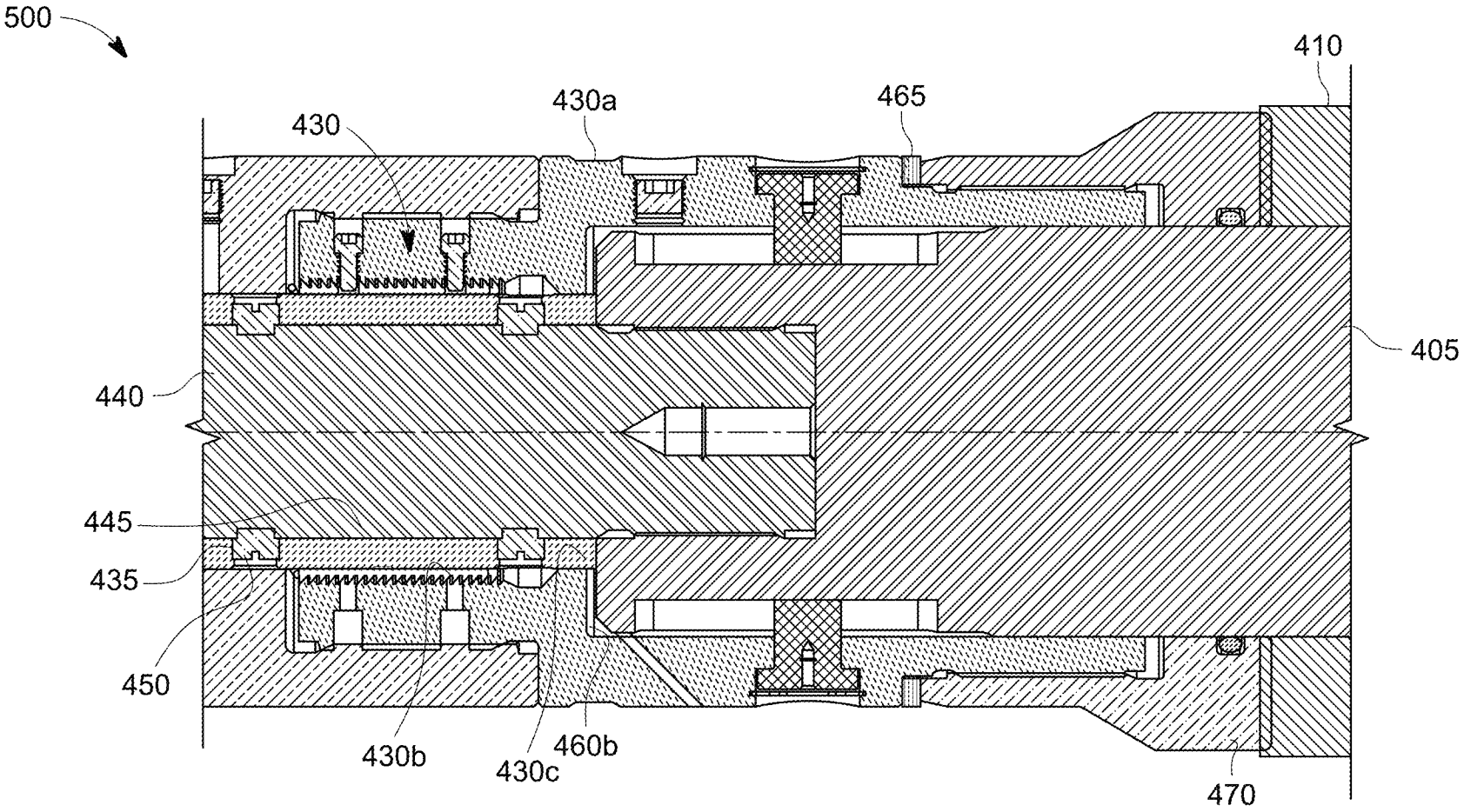

The anchoring/sealing subassembly 500 may be run-in-hole, for example in the state shown in FIGS. 5A and 5B. With the anchoring/sealing subassembly 500 run-in-hole to the proper depth, the latching feature of the latching element section (not shown) may be set. With the latching feature set, the anchoring/sealing subassembly 500 may be pushed to shear the one or more setting shear features 420, thereby setting the isolation element 410 (e.g., as shown in FIGS. 6A and 6B). The number of the ones of shear features 450 may be tailored to accommodate the appropriate, if not ideal, hold pressure for the isolation elements 410. It should be noted that too few shear features 450 will not be strong enough to hold the energized isolation element 410, and to many shear features 450 might have trouble when the system needs to shear to unset the isolation element 410 to pull the anchoring assembly 500 out of hole.

Figure 7A:
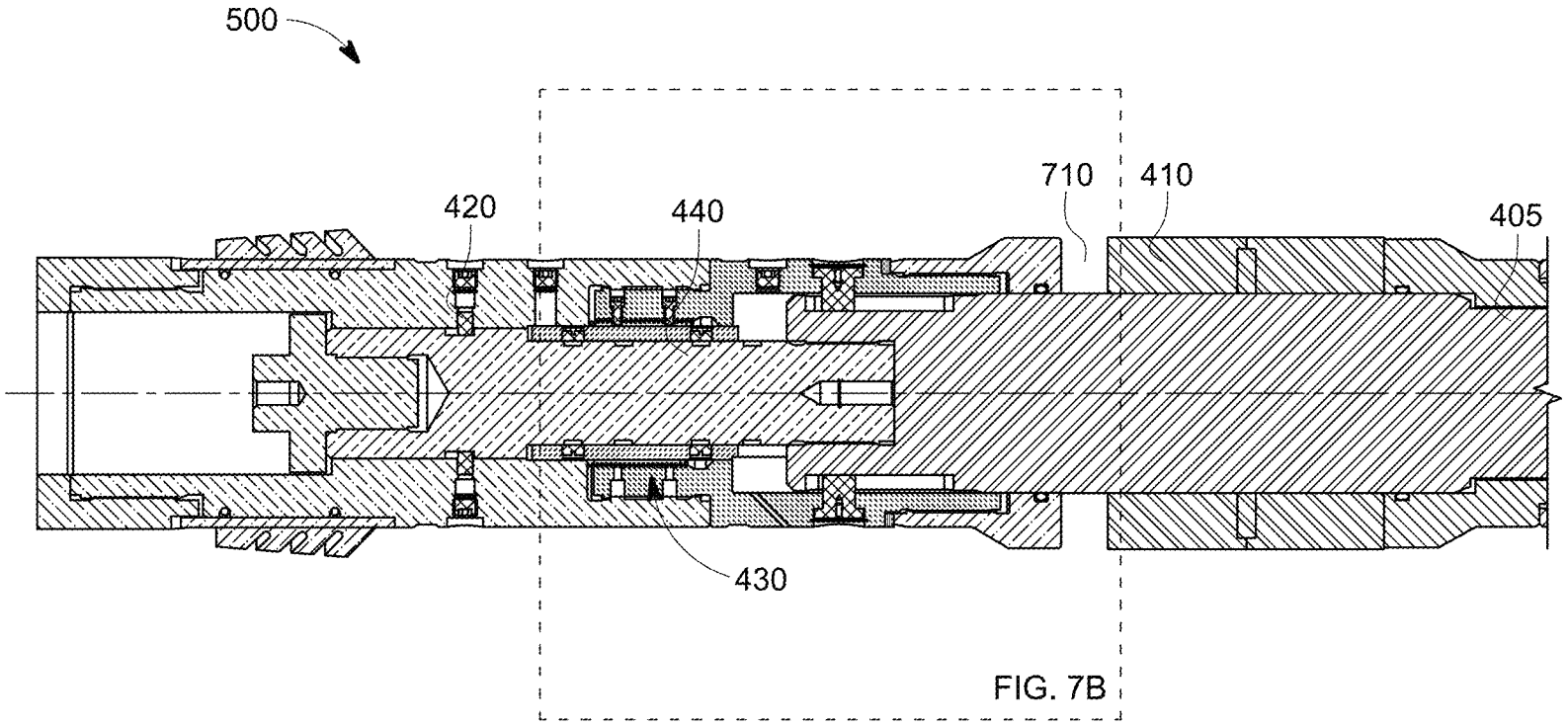
Figure 7B:
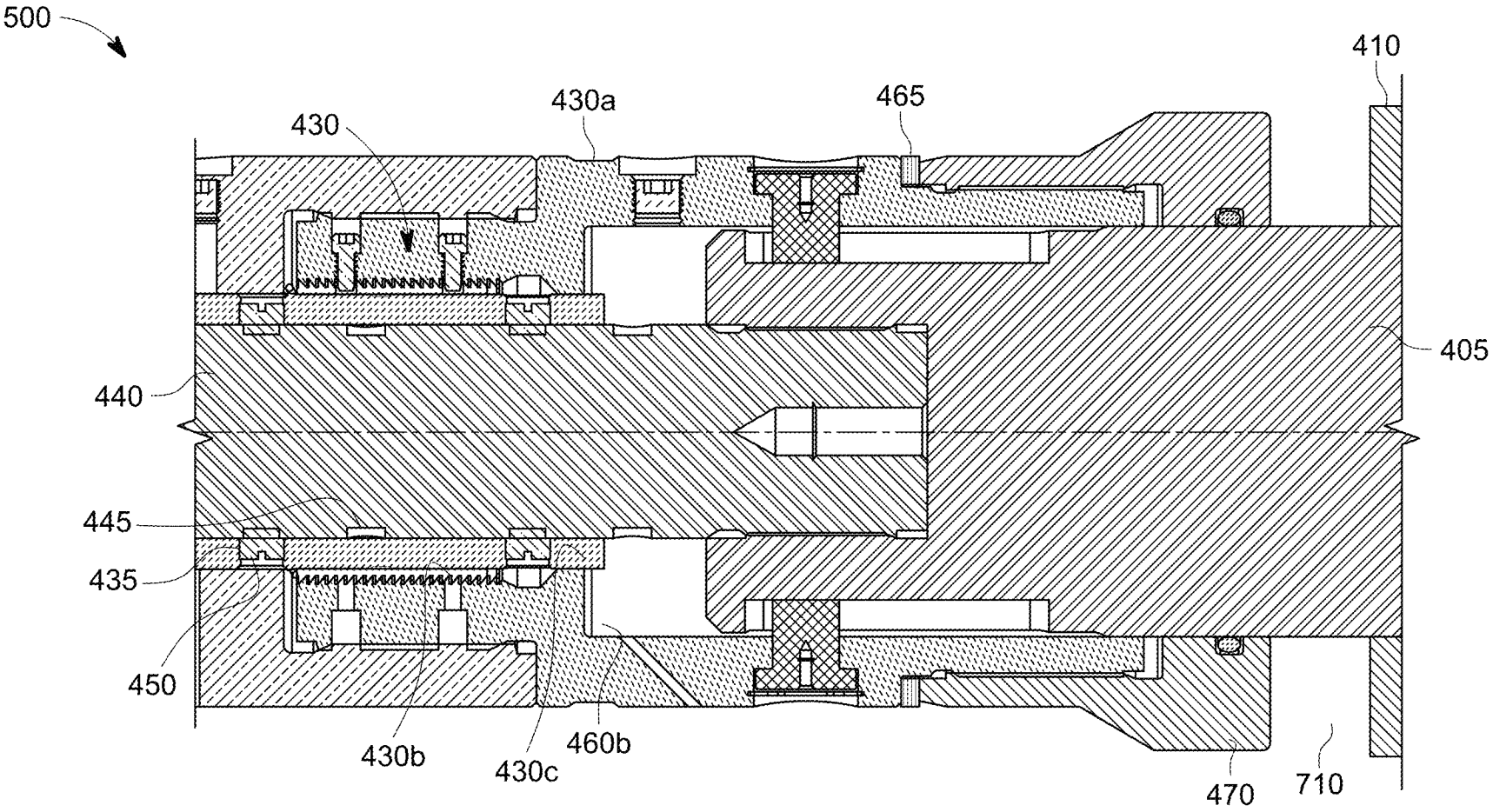
Figure 8A:
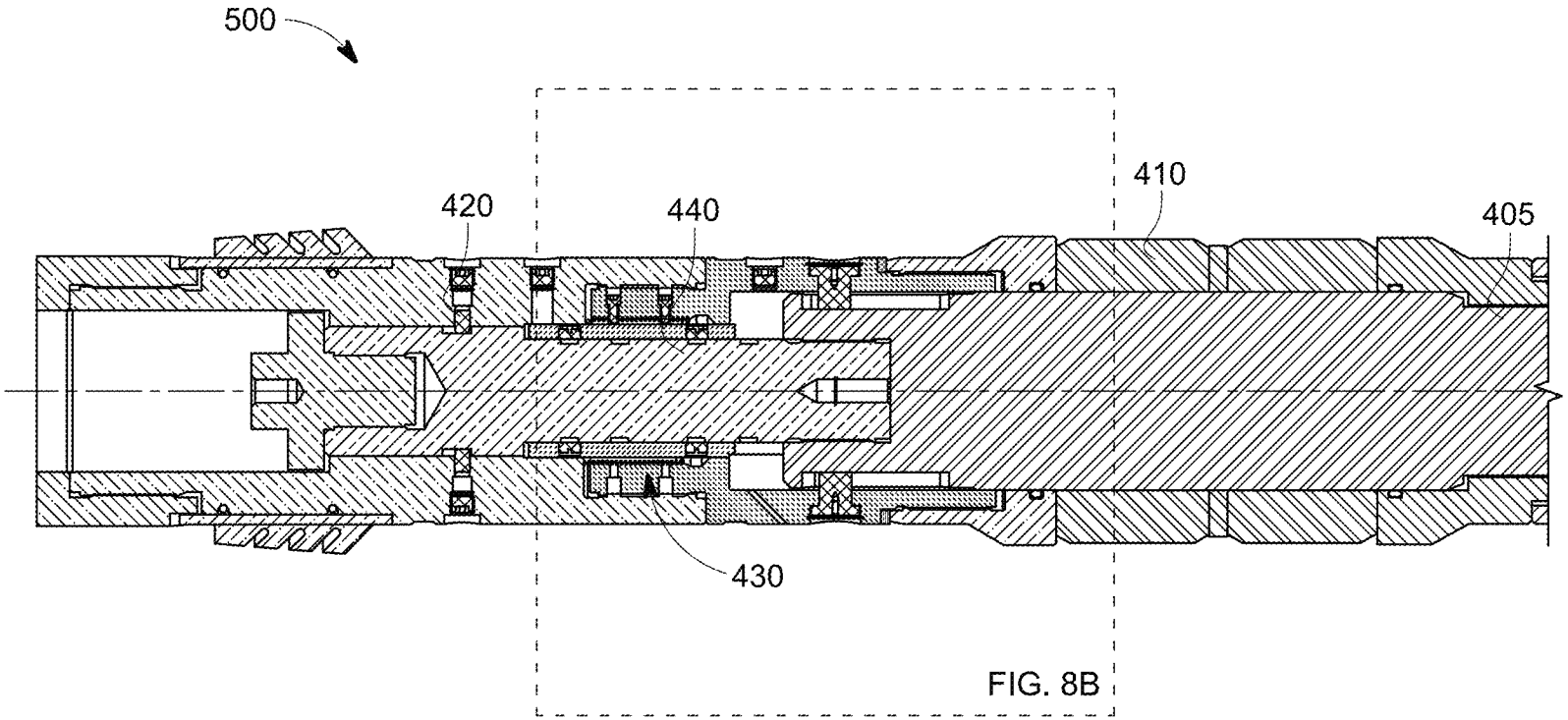
Figure 8B:
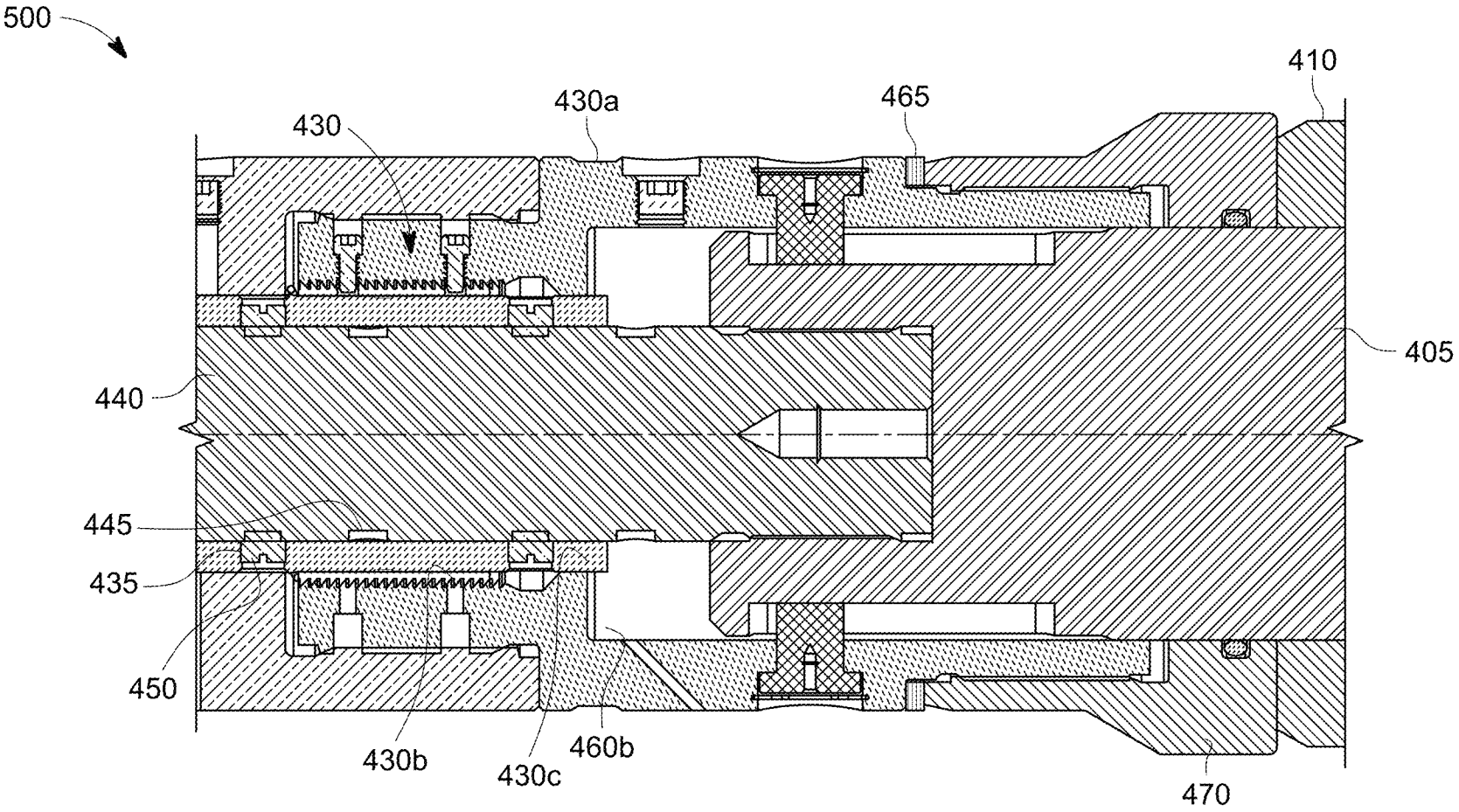

When it is time to unset the isolation element 410, and thus pull the anchoring/sealing subassembly 500 uphole, the whipstock assembly may be pulled uphole to shear the shear features 450 (e.g., as shown in FIGS. 7A and 7B). In the embodiment of FIGS. 7A and 7B, the shearing provides a relaxation gap 710 (e.g., unsetting gap) between the upper support shoe 470 and the radially expanded isolation element 410. The relaxation gap 710, in at least one embodiment, allows the isolation element 410 to move over time from the radially expanded state to the radially retracted state, such that it will not swab as it is being returned uphole (e.g., as shown in FIGS. 8A and 8B). The shearing of the shear features 450 may additionally return at least a portion of the increased stroke gap 460*b*, as shown.

At this stage, the anchoring/sealing subassembly 500 is ready to be pulled uphole without worrying about swabbing (e.g., as shown in FIGS. 8A and 8B). In certain embodiments, a washover assembly may engulf and remove the anchoring/sealing subassembly 500 (e.g., isolation element 410), as opposed to the pulling and shearing of the one or more shear features 450. In at least one embodiment, the upper support shoe 470 comprises an easily millable material, and thus the engulfing may be used to mill the upper support shoe 470 and/or isolation element 410, and thereby release the anchoring/sealing subassembly 500 from the tubular.

Aspects disclosed herein include:

A. An anchoring/sealing subassembly, the anchoring/sealing subassembly including: 1) an isolation element mandrel; 2) an isolation element positioned about the isolation element mandrel, the isolation element configured to move between a radially retracted state and a radially expanded state; 3) a shear mandrel coupled to the isolation element mandrel; 4) a ratch latch body coupled to the isolation element, the ratch latch body including a slip ring and a stroke sleeve, the ratch latch body configured to hold the isolation element in the radially expanded state; 5) a row of radially spaced apart slip ring shear feature openings located in the slip ring; and 6) a row of radially spaced apart shear mandrel shear feature openings located in the isolation element mandrel, the row of slip ring shear feature openings and the row of shear mandrel shear feature openings operable to receive ones of shear features to shearingly couple the slip ring and the isolation element mandrel together.

B. A well system, the well system including: 1) a main wellbore located in a subterranean formation; 2) a lateral wellbore extending from the main wellbore; and 3) a whipstock assembly including an anchoring/sealing subassembly positioned proximate an intersection between the main wellbore and the lateral wellbore, the anchoring/sealing subassembly including: a) an isolation element mandrel; b) an isolation element positioned about the isolation element mandrel, the isolation element configured to move between a radially retracted state and a radially expanded state; c) a shear mandrel coupled to the isolation element mandrel; d) a ratch latch body coupled to the isolation element, the ratch latch body including a slip ring and a stroke sleeve, the ratch latch body configured to hold the isolation element in the radially expanded state; e) a row of radially spaced apart slip ring shear feature openings located in the slip ring; and f) a row of radially spaced apart shear mandrel shear feature openings located in the isolation element mandrel, the row of slip ring shear feature openings and the row of shear mandrel shear feature openings operable to receive ones of shear features to shearingly couple the slip ring and the isolation element mandrel together.

C. A method, the method including: 1) positioning a whipstock assembly including an anchoring/sealing subassembly proximate an intersection between a main wellbore and a lateral wellbore, the anchoring/sealing subassembly including: a) an isolation element mandrel; b) an isolation element positioned about the isolation element mandrel, the isolation element configured to move between a radially retracted state and a radially expanded state; c) a shear mandrel coupled to the isolation element mandrel; d) a ratch latch body coupled to the isolation element, the ratch latch body including a slip ring and a stroke sleeve, the ratch latch body configured to hold the isolation element in the radially expanded state; e) a row of radially spaced apart slip ring shear feature openings located in the slip ring; and f) a row of radially spaced apart shear mandrel shear feature openings located in the isolation element mandrel, the row of slip ring shear feature openings and the row of shear mandrel shear feature openings operable to receive ones of shear features to shearingly couple the slip ring and the isolation element mandrel together; and 2) placing weight down on the anchoring/sealing assembly to cause the isolation element to move from the radially retracted state to the radially expanded state.

Aspects A, B, and C may have one or more of the following additional elements in combination: Element 1: wherein wherein the row of radially spaced apart slip ring shear feature openings is a first row of radially spaced apart slip ring shear feature openings, and further including a second row of radially spaced apart slip ring shear feature openings axially offset from the first row of radially spaced apart slip ring shear feature openings, and further wherein the row of radially spaced apart shear mandrel shear feature openings is a first row of radially spaced apart shear mandrel shear feature openings, and further including a second row of radially spaced apart shear mandrel shear feature openings axially offset from the first row of radially spaced apart shear mandrel shear feature openings, the first and second rows of slip ring shear feature openings and the first and second rows of shear mandrel shear feature openings operable to receive ones of shear features to shearingly couple the slip ring and the isolation element mandrel together. Element 2: wherein further including ones of shear features located in the first and second rows of the slip ring shear feature openings and the first and second rows of the shear mandrel shear feature openings. Element 3: further including ones of shear features located in the row of the slip ring shear feature openings and the row of the shear mandrel shear feature openings. Element 4: further including an increased stroke gap located between the stroke sleeve and the isolation element mandrel. Element 5: further including a dampening material located in the increased stroke gap, the dampening material configured to reduce backlash that may be generated when the ones of the shear features shear. Element 6: wherein the dampening material is a fluid dampener. Element 7: further including an upper support shoe positioned between the stroke sleeve and the isolation element. Element 8: further including one or more stroke adjustment spacers located between the stroke sleeve and the upper support shoe. Element 9: wherein two or more different sized spacers are located between the stroke sleeve and the upper support shoe.

Those skilled in the art to which this application relates will appreciate that other and further additions, deletions, substitutions and modifications may be made to the described embodiments.

What is claimed is:

1. An anchoring/sealing subassembly, comprising:

an isolation element mandrel;

an isolation element positioned about the isolation element mandrel, the isolation element configured to move between a radially retracted state and a radially expanded state;

a shear mandrel coupled to the isolation element mandrel, the isolation element not positioned radially about the shear mandrel;

a ratch latch body coupled to the isolation element, the ratch latch body including a slip ring and a stroke sleeve, the ratch latch body configured to hold the isolation element in the radially expanded state;

a row of radially spaced apart slip ring shear feature openings located in the slip ring; and a row of radially spaced apart shear mandrel shear feature openings located in the shear mandrel, the row of slip ring shear feature openings and the row of shear mandrel shear feature openings operable to receive ones of shear features to shearingly couple the slip ring and the shear mandrel together.

2. The anchoring/sealing subassembly as recited in claim 1, wherein the row of radially spaced apart slip ring shear feature openings is a first row of radially spaced apart slip ring shear feature openings, and further including a second row of radially spaced apart slip ring shear feature openings axially offset from the first row of radially spaced apart slip ring shear feature openings, and further wherein the row of radially spaced apart shear mandrel shear feature openings is a first row of radially spaced apart shear mandrel shear feature openings, and further including a second row of radially spaced apart shear mandrel shear feature openings axially offset from the first row of radially spaced apart shear mandrel shear feature openings, the first and second rows of slip ring shear feature openings and the first and second rows of shear mandrel shear feature openings operable to receive ones of shear features to shearingly couple the slip ring and the isolation element mandrel together.

3. The anchoring/sealing subassembly as recited in claim 2, further including ones of shear features located in the first and second rows of the slip ring shear feature openings and the first and second rows of the shear mandrel shear feature openings.

4. The anchoring/sealing subassembly as recited in claim 1, further including ones of shear features located in the row of the slip ring shear feature openings and the row of the shear mandrel shear feature openings.

5. The anchoring/sealing subassembly as recited in claim 1, further including an increased stroke gap located between the stroke sleeve and the isolation element mandrel.

6. The anchoring/sealing subassembly as recited in claim 5, further including a dampening material located in the increased stroke gap, the dampening material configured to reduce backlash generated when the ones of the shear features shear.

7. The anchoring/sealing subassembly as recited in claim 6, wherein the dampening material is a fluid dampener.

8. The anchoring/sealing subassembly as recited in claim 1, further including an upper support shoe positioned between the stroke sleeve and the isolation element.

9. The anchoring/sealing subassembly as recited in claim 8, further including one or more stroke adjustment spacers located between the stroke sleeve and the upper support shoe.

10. The anchoring/sealing subassembly as recited in claim 9, wherein two or more different sized spacers are located between the stroke sleeve and the upper support shoe.

11. A well system, comprising:

a main wellbore located in a subterranean formation;

a lateral wellbore extending from the main wellbore; and a whipstock assembly including an anchoring/sealing subassembly positioned proximate an intersection between the main wellbore and the lateral wellbore, the anchoring/sealing subassembly including:

an isolation element mandrel;

an isolation element positioned about the isolation element mandrel, the isolation element configured to move between a radially retracted state and a radially expanded state;

a shear mandrel coupled to the isolation element mandrel, the isolation element not positioned radially about the shear mandrel;

a ratch latch body coupled to the isolation element, the ratch latch body including a slip ring and a stroke sleeve, the ratch latch body configured to hold the isolation element in the radially expanded state;

a row of radially spaced apart slip ring shear feature openings located in the slip ring; and a row of radially spaced apart shear mandrel shear feature openings located in the shear mandrel, the row of slip ring shear feature openings and the row of shear mandrel shear feature openings operable to receive ones of shear features to shearingly couple the slip ring and the shear mandrel together.

12. The well system as recited in claim 11, wherein the row of radially spaced apart slip ring shear feature openings is a first row of radially spaced apart slip ring shear feature openings, and further including a second row of radially spaced apart slip ring shear feature openings axially offset from the first row of radially spaced apart slip ring shear feature openings, and further wherein the row of radially spaced apart shear mandrel shear feature openings is a first row of radially spaced apart shear mandrel shear feature openings, and further including a second row of radially spaced apart shear mandrel shear feature openings axially offset from the first row of radially spaced apart shear mandrel shear feature openings, the first and second rows of slip ring shear feature openings and the first and second rows of shear mandrel shear feature openings operable to receive ones of shear features to shearingly couple the slip ring and the isolation element mandrel together.

13. The well system as recited in claim 12, further including ones of shear features located in the first and second rows of the slip ring shear feature openings and the first and second rows of the shear mandrel shear feature openings.

14. The well system as recited in claim 11, further including ones of shear features located in the row of the slip ring shear feature openings and the row of the shear mandrel shear feature openings.

15. The well system as recited in claim 11, further including an increased stroke gap located between the stroke sleeve and the isolation element mandrel.

16. The well system as recited in claim 15, further including a dampening material located in the increased stroke gap, the dampening material configured to dampen a shock generated when the ones of the shear features shear.

17. The well system as recited in claim 16, wherein the dampening material is a fluid dampener.

18. The well system as recited in claim 11, further including an upper support shoe positioned between the stroke sleeve and the isolation element.

19. The well system as recited in claim 18, further including one or more stroke adjustment spacers located between the stroke sleeve and the upper support shoe.

20. The well system as recited in claim 19, wherein two or more different sized spacers are located between the stroke sleeve and the upper support shoe.

21. A method, comprising:

positioning a whipstock assembly including an anchoring/sealing subassembly proximate an intersection between a main wellbore and a lateral wellbore, the anchoring/sealing subassembly including:

an isolation element mandrel;

an isolation element positioned about the isolation element mandrel, the isolation element configured to move between a radially retracted state and a radially expanded state;

a shear mandrel coupled to the isolation element mandrel, the isolation element not positioned radially about the shear mandrel;

a ratch latch body coupled to the isolation element, the ratch latch body including a slip ring and a stroke sleeve, the ratch latch body configured to hold the isolation element in the radially expanded state;

a row of radially spaced apart slip ring shear feature openings located in the slip ring; and a row of radially spaced apart shear mandrel shear feature openings located in the shear mandrel, the row of slip ring shear feature openings and the row of shear mandrel shear feature openings operable to receive ones of shear features to shearingly couple the slip ring and the shear mandrel together; and placing weight down on the anchoring/sealing assembly to cause the isolation element to move from the radially retracted state to the radially expanded state.

* * * * *